US005727279A

United States Patent [19]

Pike, Jr.

[11] Patent Number: 5,727,279

[45] Date of Patent: Mar. 17, 1998

[54] APPARATUS FOR GRADING WET CONCRETE

[76] Inventor: Robert Lee Pike, Jr., 9013 Cinderella La., Louisville, Ky. 40229

[21] Appl. No.: 701,720

[22] Filed: Aug. 22, 1996

[51] Int. Cl.[6] ..... E01C 19/12; B05C 17/10

[52] U.S. Cl. ..... 15/235.4; 404/97

[58] Field of Search ..... 15/235.4–235.8, 15/104.001; 404/97, 118

[56] References Cited

U.S. PATENT DOCUMENTS

| | | | |
|---|---|---|---|
| D. 134,265 | 11/1942 | La Manca . | |
| 1,229,630 | 6/1917 | McCaskey | 15/235.7 |
| 1,646,649 | 10/1927 | Kriegl . | |
| 1,662,170 | 3/1928 | Kahlstrom . | |
| 1,797,484 | 3/1931 | Smith . | |
| 3,302,233 | 2/1967 | Sebastiani . | |
| 3,613,243 | 10/1971 | Baker | 15/235.5 |
| 5,476,341 | 12/1995 | Johnson | 401/118 |
| 5,540,519 | 7/1996 | Weber | 15/235.4 |

FOREIGN PATENT DOCUMENTS

| | | | |
|---|---|---|---|
| 1082475 | 9/1967 | United Kingdom | 15/235.4 |

*Primary Examiner*—Randall Chin

*Attorney, Agent, or Firm*—Middleton & Reutlinger; John F. Salazar

[57] ABSTRACT

A concrete grading tool for grading, leveling and sealing wet concrete is shown and described. The grading tool is comprised of a grading head which is made of a lightweight material such as aluminum and has a long handle extending outward therefrom. The grading head of the present invention is designed such that it floats on top of the wet concrete. It has a triangular design and is substantially hollow therethrough. All three sides are kept at a minimal thickness. On the rearward facing surface is located an attachment block which threadably receives the handle. The handle has a first and a second support member angled downward and also attached to the grading head for additional support of the handle away from the centermost portion. The grading tool allows the user to rake, level, screed and place a precise finish on wet concrete.

6 Claims, 5 Drawing Sheets

APPARATUS FOR GRADING WET CONCRETE

BACKGROUND OF THE INVENTION

1. Field of the Invention

The present invention relates to an apparatus which allows the user to grade wet concrete and more particularly to an apparatus which allows the user to rake, level, screed and seal at final grade wet concrete.

2. Discussion of the Prior Art

Many different apparatus have been used to properly grade wet concrete after it is poured from a concrete truck. The work is labor intensive typically involving up to three individuals. It is also completed under strict time constraints because the concrete must be graded and sealed while the concrete is still wet and gradable. The grading job historically has required a rake and a screed board to complete the grading or leveling process. Once wet concrete is poured, it must be spread out and graded by use of a rake or similar device to spread the concrete over the area to be covered. Typically, this step brings the freshly poured concrete only within one inch of the final grade but cannot level the wet concrete to a more accurate depth. A rake does not allow the concrete to be spread in an even fashion so a screed board is used to level the rough graded concrete to within about 1/16 of an inch to final grade. A screed board consists of a long board with a worker on each end squatting down and pulling the board horizontally over the graded wet rough concrete spreading it out closely to final grade. The screed board can be either a straight edge board or a tubular screed, neither of which can place a sealed finish on the wet concrete. Additionally, a screed board cannot spread the concrete to the extent a rake can because the concrete tends to stick to the bottom of the screed board nor can the screen board agitate and spread the wet concrete as a rake can. During the leveling process, a third worker must remove and regrade excess concrete in front of the screed board by use of the rake. This grading process requires three or more workers to accomplish, is extremely labor intensive and is quite slow, an undesirable side effect due to the time constraints faced when dealing with wet concrete. In the last step of the grading process, a bull float is utilized to place a precise finish on the fresh concrete. However, due to the bull float's size and weight, it cannot distribute concrete like a rake, nor can it pull concrete to a homogeneous level like a screed board.

Nothing in the prior art allows a single person to grade concrete with relative ease and manipulate the concrete to final grade and seal the concrete in short order. U.S. Pat. No. 1,797,484 teaches a concrete finishing tool which utilizes a triangular frame to prevent a wooden float board from warping due to the tendency of the wood to swell. However, this device does not allow the user to grade concrete and spread the wet concrete easily because of the base portion of the apparatus which will not spread the concrete nor raise and lift the concrete to other areas. This apparatus also cannot replace the action of a rake because of the sharp angles formed along the bottom surface of the device and the inherent weight of the device due to its size. Design Patent 134,265 shows another device utilized as a concrete finishing tool. However, because of the thickness of the bottom surface of this device, the angled or tapered ends and also the ridges formed along the bottom surface, this device does not provide the ability to grade wet concrete. This device will only place a rough finish on the surface of already graded concrete.

SUMMARY OF THE INVENTION

It is an object of the present invention to provide a concrete grading apparatus which allows the user to complete the spreading, grading and sealing tasks with a single tool and with only a single person performing the entire grading process. It is a further object of the present invention to provide a tool which is lightweight and allows the user to stand upright while spreading, leveling and placing at final grade the wet concrete. The apparatus of the present invention accomplishes these objectives by providing a lightweight tool which adequately spreads, levels and final grades wet concrete with comparatively little physical effort because of the specific design of the grading head of the tool.

More particularly, the present invention comprises a concrete grading tool which has a hollow triangular head and a handle extending therefrom. The apparatus is constructed of strong lightweight aluminum having a relatively thin thickness thereby increasing the maneuverability of the apparatus in the wet concrete. Also, the leading and trailing edge of the apparatus prevents the concrete from building up on the face of the grading tool and insures the ability of the apparatus to spread the wet concrete to an appropriate final grade as the wet concrete is being poured from the concrete truck.

Finally, the present invention comprises a concrete grading tool, comprising: a hollow triangular grading head having a front surface, a back surface and a bottom surface; and, a handle extending outward from said back surface.

BRIEF DESCRIPTION OF THE DRAWINGS

A better understanding of the invention will be had upon reference to the following description in conjunction with the accompanying drawings in which like numerals refer to like parts and wherein.

DETAILED DESCRIPTION OF THE PREFERRED EMBODIMENT

Figure 1:
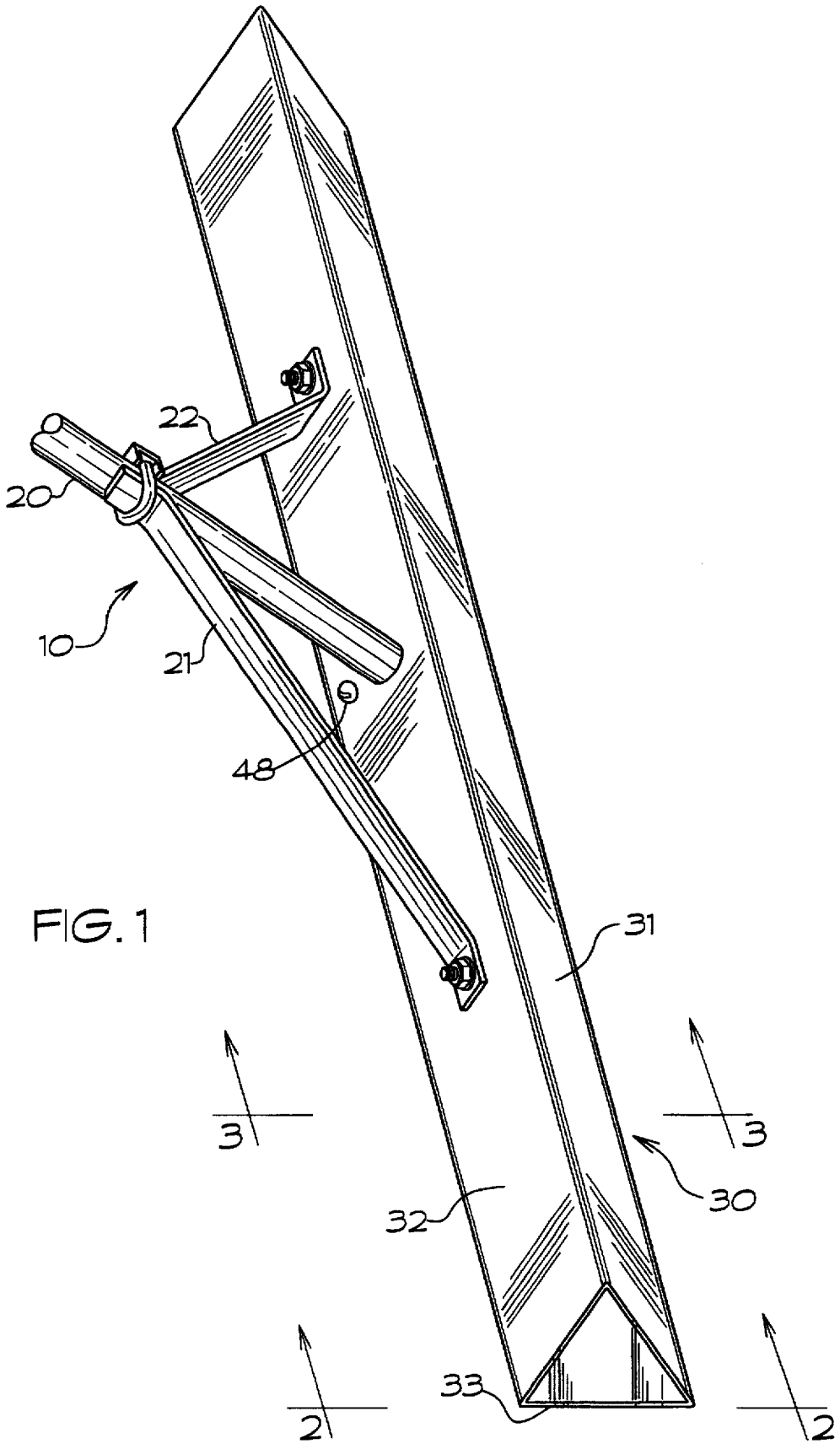
FIG. 1 is a perspective view of the concrete grading tool of the present invention.

The concrete grading tool 10 of the present invention is shown in FIG. 1 as comprising a handle 20, handle side support members 21 and 22 and a longitudinally extending grading head 30. The grading head 30 of the apparatus is triangular in shape and is hollow to allow for easy manipulation of the apparatus in the wet concrete by the user. The triangular grading head 30 has front facing surface 31, rear facing surface 32, bottom surface 33 and has a length of, for example, about 42 inches. The head of the apparatus is made of extruded aluminum or other lightweight and rigid material which allows the device to move and spread heavy wet concrete and place the concrete at final grade while also placing a near finish seal on the top of the wet concrete. The handle 20 is centrally attached to rear surface 32 of the grading head 30 and may be of any strong, durable and lightweight material, such as extruded aluminum or magnesium. Side support members 21 and 22 allow the user to place a horizontal and vertical force on the grading tool 10 by pushing or pulling the grading tool by handle 20 while spreading the wet concrete to final thickness. The grading tool 10 allows a user to spread freshly poured concrete to a rough grade thickness, much as a rake does in addition to placing the concrete at final grade. The grading tool is strong and sturdy enough to allow a single operator to spread the wet concrete without undue force or collection of wet concrete on the front or rear surfaces 31 and 32. Additionally, the grading tool 10 enables the user to level the concrete to an even and final grade because of the angles which the front and rear surfaces 31 and 32 are formed as compared to bottom surface 33 and also because of the smooth bottom surface 33 in contact with the concrete. These design constructs provide for moving the concrete in adequate fashion allowing excess concrete to form on the front or rear facing surfaces 31 and 32, depending on whether the tool is being pushed or pulled, and depositing any excess wet concrete in areas where the poured concrete may be thin. Finally, the concrete grading tool 10 of the present invention allows the user to seal the wet concrete and place a smooth finish on the upper surface of the freshly poured concrete because of the smooth nature of the extruded aluminum present on the outer surface of the grading tool.

Figure 2:
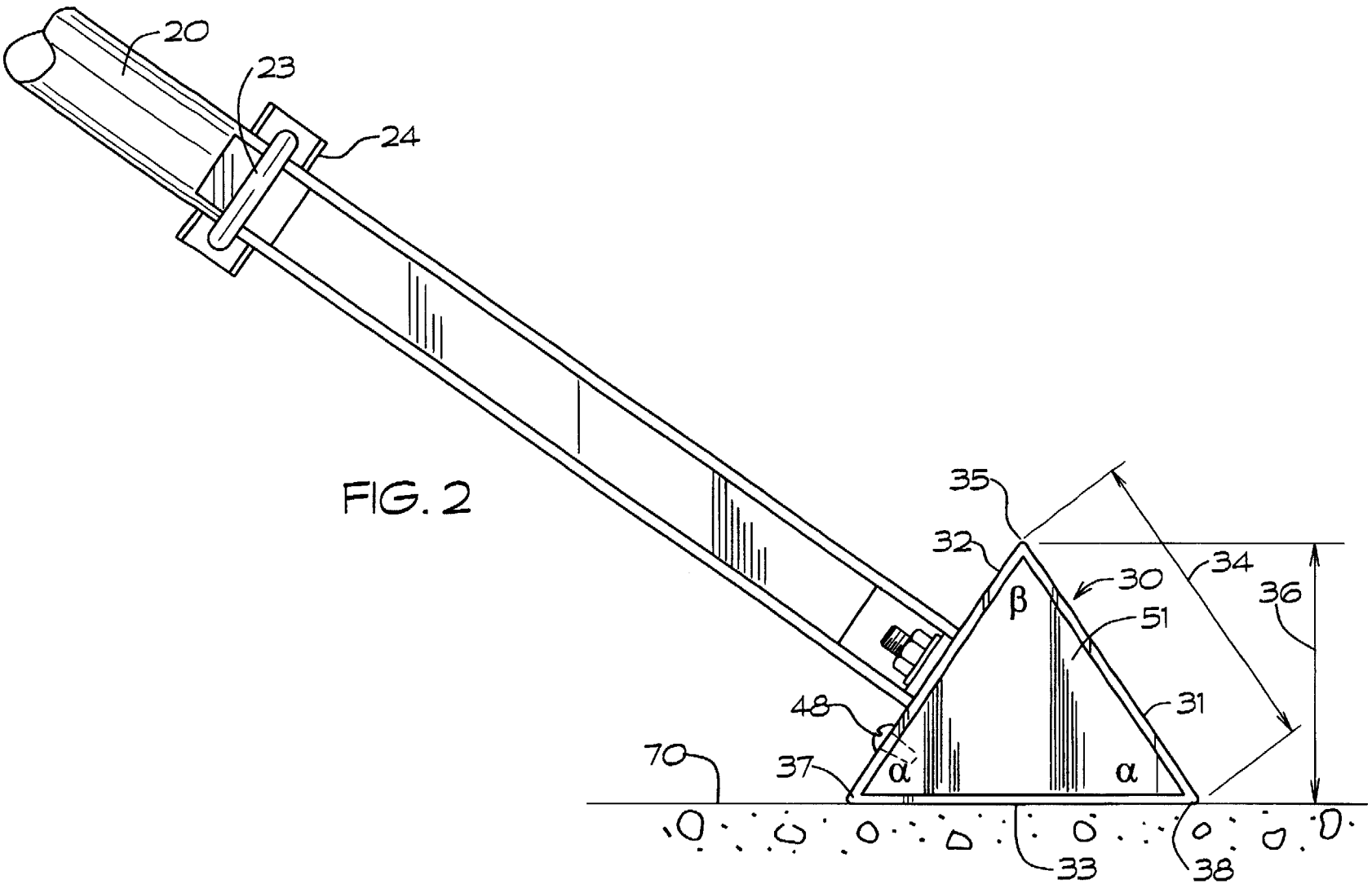
FIG. 2 is a side view of the grading tool of FIG. 1.
Figure 3:
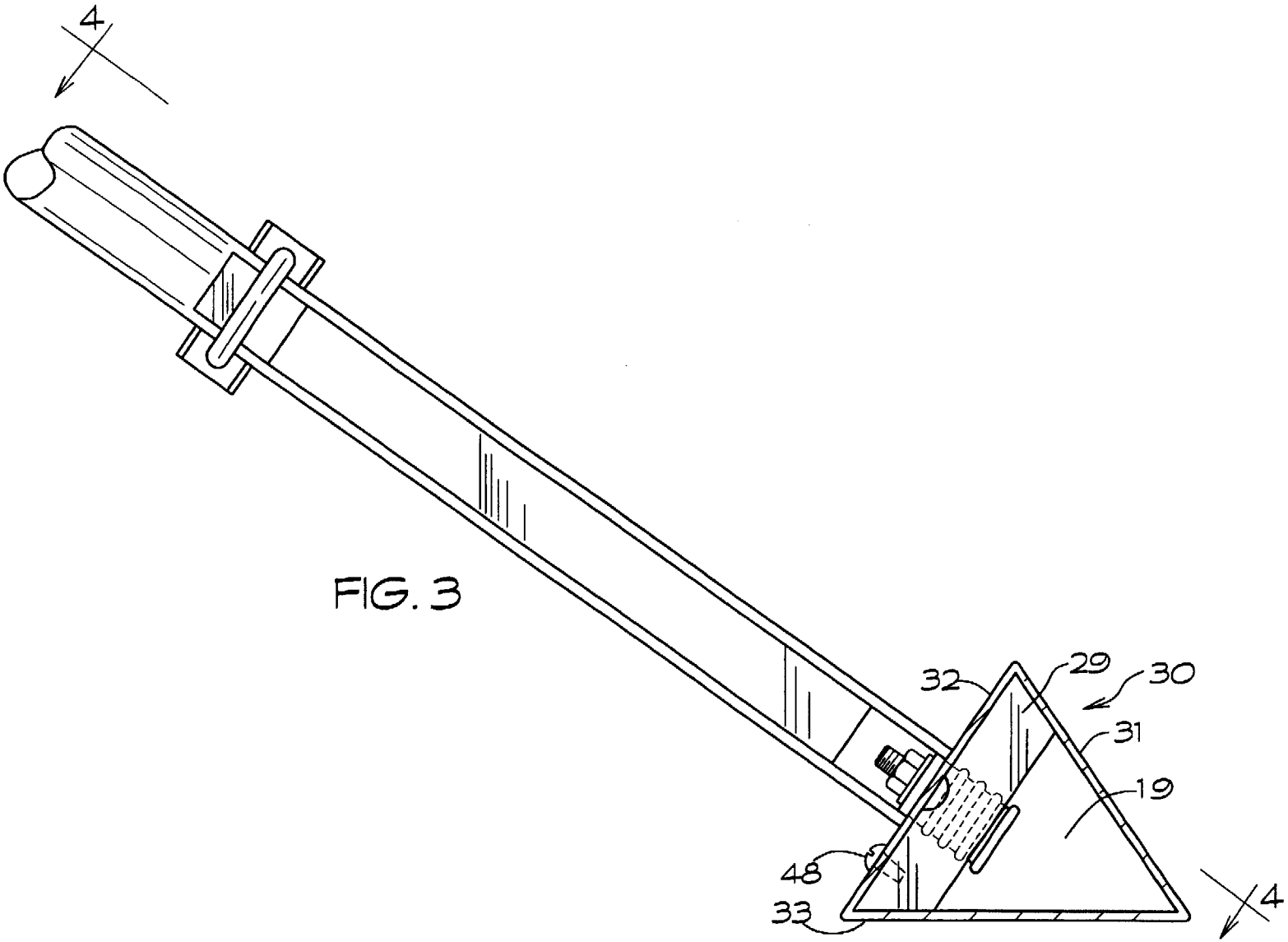
FIG. 3 is a sectional side view of the concrete grading tool of FIG. 1 showing the interior of the grading head.

The concrete grading tool 10 of the present invention has as its main advancement the grading head 30, shown more clearly in FIG. 2 and FIG. 3, which has a particular design of great import to the functionality of the grading tool 10 itself. As shown in the drawings, the grading head 30 is triangular in shape and hollow, having interior space 1 extending through the entire length of the grading head 30. The grading head 30 is made of extruded aluminum making it exceptionally lightweight and easily manipulated by the user while also being strong and allowing large forces to be exerted upon it by the user while grading the wet concrete.

The grading head 30 has a thin triangular frame, shown in FIG. 2, and has a front side 31, a rear side 32 and a bottom side 33, each of said frame sides having a thickness of about 0.063 inch, for example. The combination of the hollow triangular shape and lightweight construction allows the user to manipulate and grade wet concrete in the same manner as a rake and screed board combined. The preferred length of grading head 30 is about 42 inches, for example, thereby covering a much larger area of wet concrete than a rake can manipulate and allowing the concrete to be properly graded quickly when the concrete is poured from a truck in quick fashion, especially as compared to use of a rake and screed board. The vertical height 36 of the grading head 30 from bottom surface 33 to top point 35 is about 2.819 inches, for example. The interior angles of bottom corners 37 and 38 between the bottom surface 33 and the front and rear surfaces 31 and 32, indicated in FIG. 2 as $\alpha$ is about 55 degrees. The length 34 of each front and back surface 31 and 32 is about 3.419 inches, for example. The interior angle of top corner point 35 between front and back surface 31 and 32, indicated in FIG. 2 as $\beta$, is about 70 degrees while the width of the bottom surface 33 between corners 37 and 38 is about 3.908 inches. The design of the grading head 30 outlined herein allows the tool 10 to manipulate wet concrete in such a manner that the tool 10 can act as a rake, a screed board and as a bull float for providing a first sealing operation on the wet concrete 70. A single user thus has the ability to manipulate a tool which is much larger than a rake while also enabling the user to grade the concrete to an elevation of plus or minus 1/16 inch with a single tool and with much less effort and without the requirement of several workers required to manipulate a rake and screed board concurrently. The apparatus of the present invention also decreases in half the amount of time required to place at final grade wet concrete 70 poured from a truck or other source.

The hollow triangular body of the grading head 30 and the angles of corners 37 and 38 allows the apparatus to float on top of the wet concrete 70 behind or in front of it and wedge itself under any thick or ungraded areas of unplaced concrete, allowing the excess concrete to ride up on the leading face 31 or 32 of this tool, depending on whether it is being pulled or pushed. The excess concrete which rides up on the leading face 31 or 32 automatically falls to any area which is lacking in concrete at the same line of grade as the tool is passed over the different areas of ungraded wet concrete. The hollow structure of the grading head 30 allows the user to easily move and spread the concrete to the appropriate grade with much less effort while also preventing the necessity of having two workers squat down in the wet concrete to move a screed board across the top thereof for leveling. Historically, during the raking and rough grading of wet concrete, one worker is required to spread wet concrete with a rake while two others utilize the screed board to grade the concrete. The individual with the rake typically is required to remove the excess concrete which forms on the front leading edge of the screed board and spread said excess concrete over the remaining low spots in the poured concrete with said rake. The concrete grading apparatus 10 of the present invention provides the ability of a single person to complete all these tasks.

The grading tool 10 of the present invention can be utilized in the process of grading wet concrete to seal the concrete at a precise grade following raking and screeding thereby replacing the first bull floating process. The grading head 30 of the present invention has corners 37 and 38 at each end of the base side 33, each of said corners having an outside radius of about 0.10 inch, for example. This radius of corners 37 and 38 is very important to the functionality of the grading head for it allows the grading head to both wedge itself under ungraded or uneven portions of concrete for proper grading while also allowing the grading head to place a seal on the concrete. If the radius of the corners were any larger, the leading and trailing edge corners 37 and 38 of the grading head 30 would not provide the ability to raise and displace for proper grading of the wet concrete. If the radius of the corners 37 and 38 were any narrower, the leading and trailing edge of the grading tool, 10 would cut into the wet concrete as the device was being pulled thereby preventing the adequate grading of the concrete by grading tool 10. The radius of corners 37 and 38 and the interior angle of corners 37 and 38 allow the apparatus to glide over the top of the wet concrete after it is at finished grade sealing it off immediately.

The bottom side of the grading head 10 has a thickness of 0.063 inch as previously indicated allowing the grading head 30 to float on top of the wet concrete and not allowing the apparatus to sink into the ungraded material or displace wet concrete once graded. This feature works in conjunction with the hollow interior 1, shown in the sectional view of FIG. 3, to provide some buoyancy to the grading tool 10 while it is being manipulated in the wet concrete. Thus, one worker can use the grading tool 10 to spread the concrete to rough grade and also to level the concrete off to final grade and seal the wet concrete with a single apparatus and in considerably less time.

Figure 4:
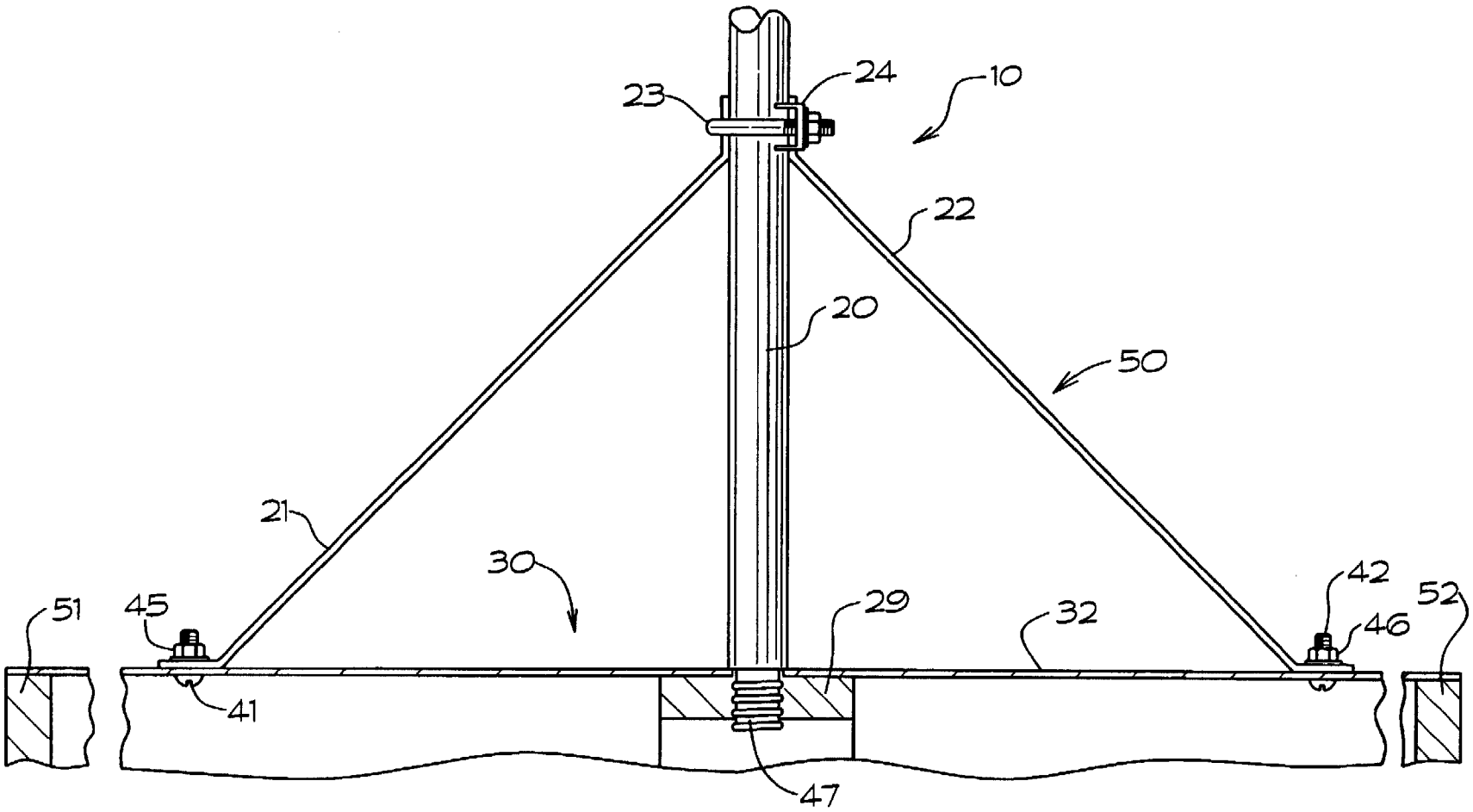
FIG. 4 is a front sectional view of FIG. 3.

Shown in FIG. 4 is the attachment assembly 50 attaching handle 20 to rear surface 32 of grading head 30. Side support members 21 and 22 are required in order to provide sufficient support for the horizontal and vertical pressure exerted on the tool as the wet concrete is manipulated and spread about. Due to the high weight of wet concrete and the force required to move the same, support members 21 and 22 must be strong and durable enough to withstand large horizontal and vertical forces. Support members 21 and 22 spread any horizontal and vertical force exerted onto handle 20 along the full horizontal plane of grading head 30 and prevent the handle 20 from bending when the grading head 30 meets with great resistance from the heavy wet concrete.

Figure 5:
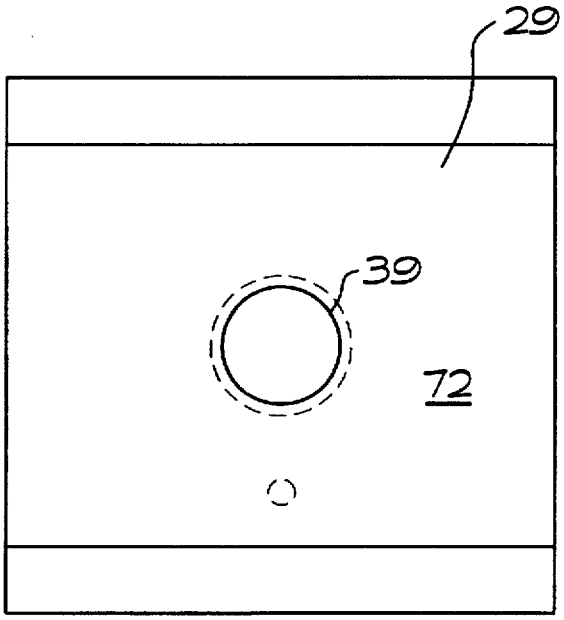
FIG. 5 is a top view of the polypropylene block inserted into the head of the grading tool which receives the handle of the present invention; and, FIG. 6 is a side view of FIG. 5.
Figure 6:
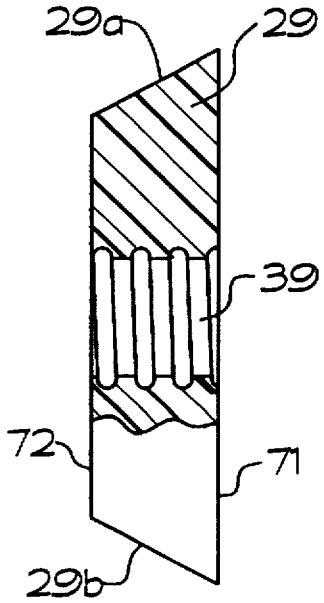

Handle 20 is further attached to grading head 30 by attachment assembly 50 which is additionally comprised of circular clamp 23, attachment bracket 24, side support member 21 and 22, carriage bolts 41 and 42 and nuts 45 and 46, and finally threaded handle end 47. Handle 20 has at its distal end threaded portion 47 for securing into threaded aperture 39 formed centrally within threaded attachment block 29, shown in FIG. 5. The attachment block 29 is preferably made of high density polypropylene. The polypropylene attachment block 29 is inserted into the hollow interior 19 of the grading head 30 at either end and aligned centrally within the grading head 30. The aperture 39 of the attachment block 29 is aligned with an aperture formed in the rear surface 32 of the grading head and held securely in place by screw 48 which extends through rear surface 32 and into the attachment block 29, shown in the sectional view of FIG. 3. The attachment block 29 shown in FIGS. 5 and 6 is about 3.25 inches square on the front side 71 having a threaded hole located centrally therein with a diameter of about 1.031 inches. The height of the attachment block on the front side 71 tapers to the rear side 72. Rear and side views of the attachment block 29 are shown in FIG. 5 and FIG. 6. The thickness of the attachment block 29 is about 0.75 inch with the height decreasing from the front side 71, shown in FIG. 6, of 3.25 inches, to the inner most height dimension on the rear side 72 of about 2.44 inches. This tapered effect of the attachment block allows the block 29 to rest securely within the hollow center 19 of the grading head 30. Thus, side **29*b* of the attachment block abuts against a portion of front surface 31 after the block abuts against a hollow interior 19 of the forming head 30. Side 29*a* of the attachment block abuts against a portion of the bottom surface 33 of the forming head after the block is inserted into the hollow interior 19 of the forming head 30. Therefore, within the hollow triangular grading head 30 there is secured the attachment block 29 to securely hold the handle 20. Attachment block 29 is of such texture to allow the threaded end 47 to be easily inserted into the grading head 30 without undue force while also providing adequate strength to hold handle 20** in place.

Handle 20 is held into place by support members 21 and 22. Both member 21 and 22 are attached to handle by circular clamp 23 and to the grading head 30 by carriage bolts and connecting nuts 41,42 and 45,46, respectively. As stated, the entire attachment assembly 50 spreads out the horizontal force applied to handle 20 by the user to the entire grading head 30 of the concrete grading tool 10 and prevents bending of the handle 20 while moving the heavy wet concrete.

At each distal end of the grading head 30 is placed a triangular plug 51 and 52, shown in FIG. 2 and FIG. 4, to seal off the hollow interior 19 of the grading head 30. This prevents wet concrete from entering the interior of the grading head thereby increasing the weight of the apparatus 10. Triangular plugs 51 and 52 can be made of polypropylene and also may have a flange circumscribing the exterior to securely hold the plug in place at the respective end of the grading head, as shown in FIG. 4.

The foregoing detailed description is given primarily for clearness of understanding and no unnecessary limitations are to be understood therefrom for modifications will become obvious to those skilled in the art upon reading this disclosure and may be made without departing from the spirit of the invention or the scope of the appended claims.

What is claimed is:

1. A concrete grading tool, comprising:

a longitudinally extending triangular grading head having a front surface, back surface and bottom surface; and, a handle extending outward from said back surface;

wherein said grading head receives an attachment block centrally therein, said attachment block having a threaded aperture for threadably receiving said handle, wherein said attachment block is made of polypropylene and has a front side and a rear side, said front side tapering in height to said rear side.

2. The concrete grading tool of claim 4 wherein said attachment block has a thickness of about 0.75 inch.

3. The concrete grading tool of claim 1 wherein said attachment block tapers from a height on said front side of about 3.25 inches to a height on said rear side of about 2.44 inches.

4. A concrete grading tool, comprising:

a hollow longitudinally extending triangular grading head having a front side, back side, bottom side and a hollow interior;

a handle extending outward from an aperture in said back side;

an attachment block inserted centrally within the hollow interior of said grading head and threadably connected to said handle;

a first and a second triangular plug inserted at each end of said grading head;

wherein said front and back sides meet to form an angle of about 70 degrees and said bottom side meets said front and back sides to form an angle of about 55 degrees.

5. A concrete grading tool, comprising:

a hollow longitudinally extending triangular grading head having a front side, back side, bottom side and a hollow interior;

a handle extending outward from an aperture in said back side;

an attachment block inserted centrally within the hollow interior of said grading head and threadably connected to said handle;

a first and a second triangular plug inserted at each end of said grading head; and, wherein said handle has a first and second side support member extending from said handle to said grading head.

6. A concrete grading tool, comprising:

a hollow longitudinally extending triangular grading head having a front side, back side, bottom side and a hollow interior;

a handle extending outward from an aperture in said back side;

an attachment block inserted centrally within the hollow interior of said grading head and threadably connected to said handle;

a first and a second triangular plug inserted at each end of said grading head, and, wherein the corners formed by said front and back sides against said bottom side have a radius of about 0.10 inch.

* * * * *